US006679016B2

(12) United States Patent
Liu

(10) Patent No.: US 6,679,016 B2
(45) Date of Patent: Jan. 20, 2004

(54) LIFT SCREEN

(76) Inventor: Yu-An Liu, No. 34, Alley 31, Lane 647, Sec. 6, Chung-Hua Rd., Hsinchu (TW)

( * ) Notice: Subject to any disclaimer, the term of this patent is extended or adjusted under 35 U.S.C. 154(b) by 118 days.

(21) Appl. No.: 10/035,316

(22) Filed: Jan. 4, 2002

(65) Prior Publication Data

US 2003/0033757 A1 Feb. 20, 2003

(30) Foreign Application Priority Data

Aug. 14, 2001 (CN) ..... 1232332

(51) Int. Cl.[7] ..... E04C 2/38

(52) U.S. Cl. ..... 52/238.1; 52/239; 52/243; 160/135

(58) Field of Search ..... 52/36.1, 238.1, 52/239, 243, 241, 242, 481.1; 160/135, 351

(56) References Cited

U.S. PATENT DOCUMENTS 4,250,676 A * 2/1981 Presby ..... 52/222
4,805,365 A * 2/1989 Bastian ..... 52/282.2
5,816,000 A * 10/1998 Izatt et al. ..... 52/238.1
6,226,931 B1 * 5/2001 Haversat ..... 52/71

* cited by examiner

*Primary Examiner*—Carl D. Friedman
*Assistant Examiner*—Jennifer I. Thissell
(74) *Attorney, Agent, or Firm*—Troxell Law Office PLLC

(57) ABSTRACT

A lift screen has an upright post, a lift mechanism, and a partition board. The upright post is a hollow body, the lift mechanism is disposed in the upright post; and the partition board provides at least an elongated slide plate at a facial side and a lower side connects with the lift mechanism. The lift screen is possible to be set up into multiple forms with multiple functions so as to offer a high mobility and more flexibility while in use and to be set up into a form with a worktable, so as to satisfy various needs and desired arrangements.

6 Claims, 7 Drawing Sheets

LIFT SCREEN

BACKGROUND OF THE INVENTION

1. Field of the Invention

The present invention relates to a lift screen, and, particularly to a lift screen used in an office.

2. Description of Related Art

Due to the expensive rent of an office of an office building in a city, how to use a limited office space effectively and to keep personal privacy off being bothered by way of a screen is a vital subject worth us to care. The Chinese Utility Model Application No. 00238270.9 filed by the present inventor discloses a lift screen as shown in FIG. 1 provides a lift mechanism (not shown) disposed in a interaction 2 of a screen base 1 and a partition board 3 with an upper cover 4 is provided on a support of a lift mechanism. When a manual handle bar 5 is turned, the lift mechanism can actuate the partition board 3 to move upward or downward. Hence, the prior art is a screen being operated easily with high mobility and the screen can be associated with a worktable as a counter in a bank or for ordinary business purpose. Besides, a mirror or a monitor can be used instead of the partition board such that the lift screen becomes a dressing table or a display for an electronic product. However, the prior art is not so compact and so handy and it is worth us to make an improvement.

SUMMARY OF THE INVENTION

An object of the present invention is to provide a lift screen, which is possible to be set up into multiple forms with multiple functions so as to offer a high mobility and more flexibility while in use and to be set up into a form with a worktable, so as to satisfy various needs and desired arrangements.

In order to reach the preceding object, the lift screen of the present invention comprises: an upright post, being hollow body; a lift mechanism, being disposed in the upright post; and a partition board, providing at least a slide plate at a facial side thereof, and a lower side thereof connecting with the lift mechanism.

The preceding lift screen further has a plurality of guiding catch grooves provided at the periphery of the upright post with the slide plate being inserted into one of the guiding catch grooves in a way of slide fit with the guiding catch groove, and an elongated trunking plate at both ends thereof providing a retaining pin or an arched retaining pin respectively being inserted into another one of the guiding catch grooves.

The preceding lift screen further has the respective guiding catch groove providing a top fitting hole.

The preceding lift screen further has the respective guiding catch groove providing a plurality of post fitting holes.

The preceding lift screen further has the arched retaining pin provides a first, a second and a third plane; the first plane is a arched plane with a retaining pin, the second and the third planes are flat and perpendicular to each other; and the third plane may provide a joint to fit with a recess at an end of the trunking plate.

The preceding lift screen further has a base being provided and the base is a worktable.

The preceding lift screen further has the partition board at an upper side thereof providing an upper cover.

The preceding lift screen further has the upright post at a periphery thereof provides a plurality of guiding catch grooves and each one of the guiding catch grooves has a top engaging hole and a lower post engaging hole; and an elongated trunking plate at both ends thereof provides a retaining pin and an arched retaining pin respectively to engage with the top fitting hole and the lower post fitting hole respectively.

The preceding lift screen further has the arched retaining pin providing a first, a second and a third plane; the first plane is a arched plane with a retaining pin, the second and the third planes are flat and perpendicular to each other; and the third plane may provide a joining hinge part to fit with a recess at an end of the trunking plate.

As the foregoing, a main feature of the present invention resides in that a light and compact lift screen with multiple functions is offered so that the lift screen can be flexibly adjusted according to different needs of the user. In addition, the present invention can be set up to constitute different arrangements for different purposes such as a personal office desk, a private conference room partition, a partition for a project research room or a test room so that the present invention can give the user a more flexible use and a more private meeting space with an environment for convenient communication need.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
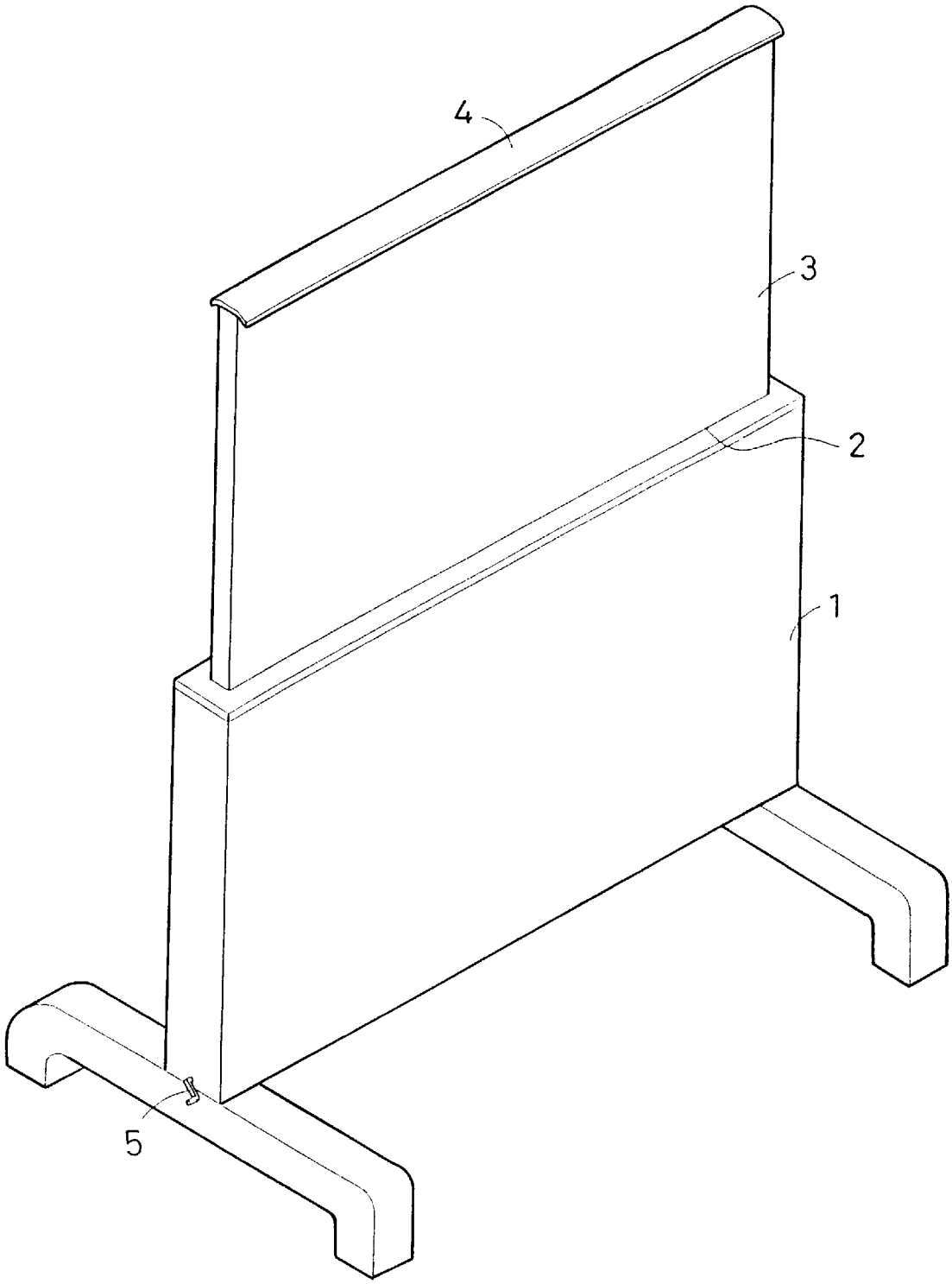
(PRIOR ART) FIG. 1
FIG. 1 is a perspective view of a conventional lift screen.
Figure 2:
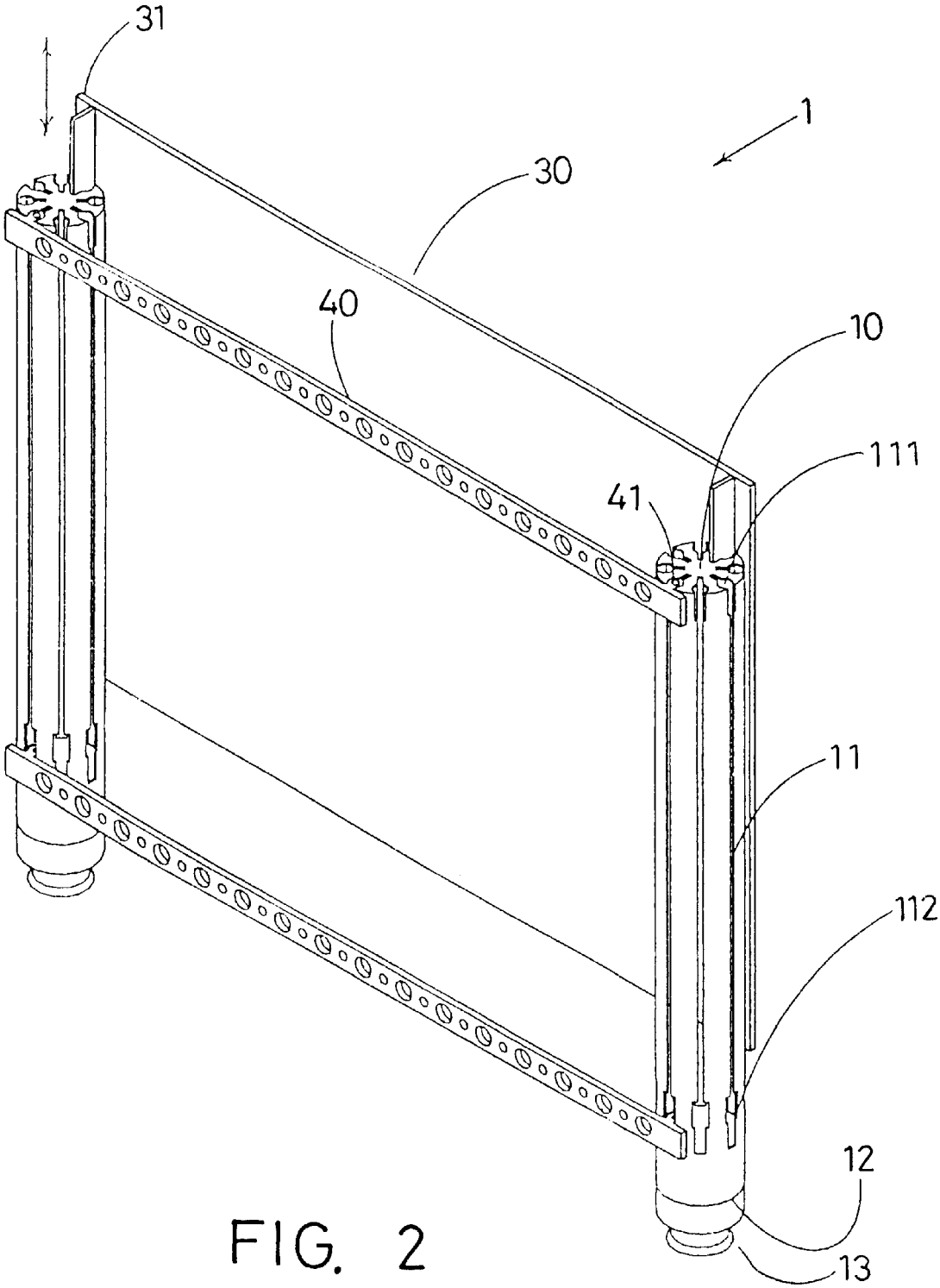
FIG. 2 is a perspective view of a lift screen according to the present invention.
Figure 3:
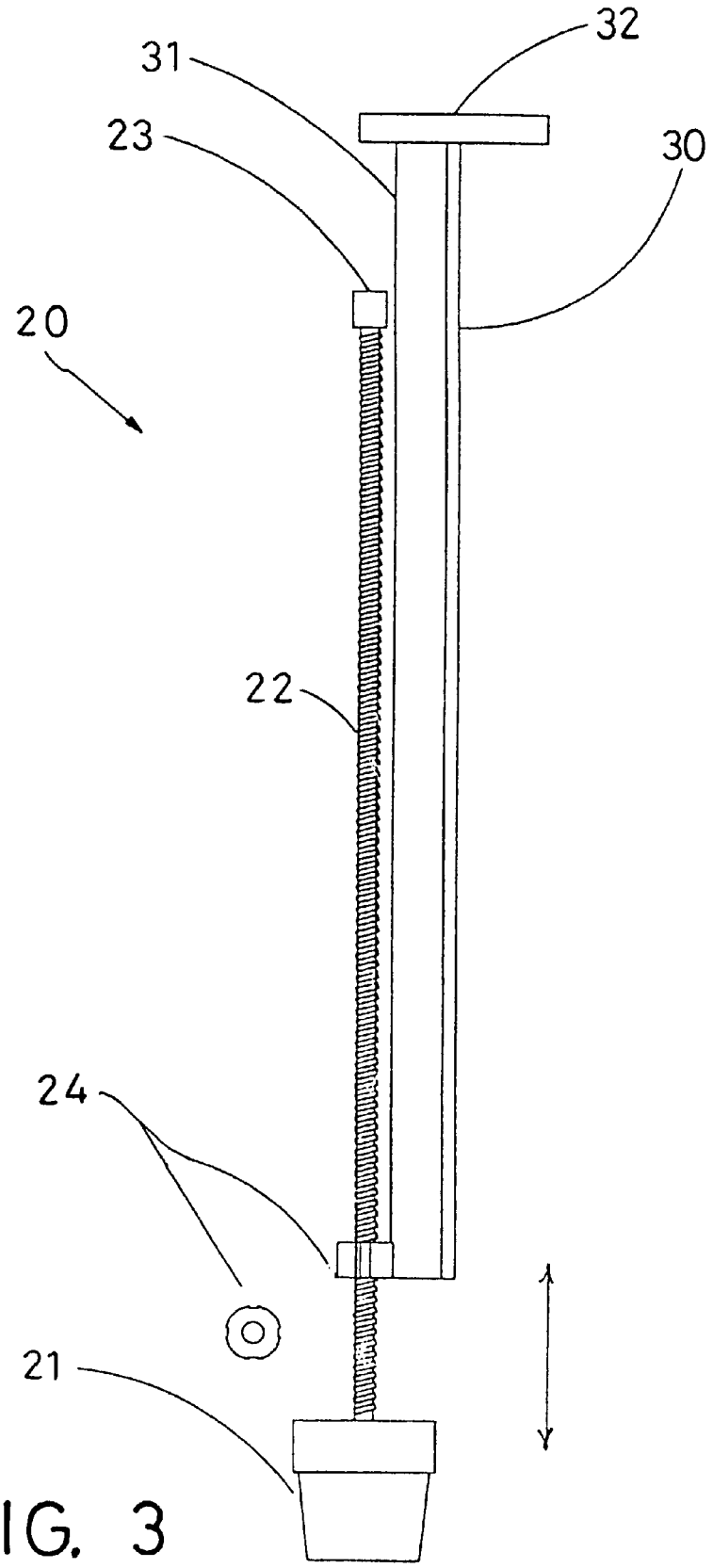
FIG. 3 is a side view of a lift mechanism in the lift screen of the present invention.

Referring to FIGS. 2 and 3, a lift screen according to the present invention comprises at least an upright post 10, a lift mechanism 20 and a partition board 30. The upright post further comprises a hollow body 12 and the lift mechanism 20 is disposed in the hollow body 12.

Referring to FIG. 3 again, the partition board 30 provides at least a slide plate 31 and the slide plate 31 at the lower side thereof connects with a threaded support bush 24 of the lift mechanism 20. The threaded support bush 24 engages with a screw rod 22 so that the slide plate 31 can move upward and downward as soon as the lift mechanism 20 is in operation. The lift mechanism 20 comprises a motor 21 with a shaft thereof connecting with the screw rod 22 and the screw rod 22 at an upper end thereof movably fits with a bearing 23, which is fixedly attached to the top of the hollow body 12 of the upright post 10. As soon as the motor 21 starts to run and rotates the screw rod 22, the threaded support bush 24 may move up and down freely together with the slide plate 31 and the partition board 30 to perform the lift function thereof. Further, the partition board 30 at upper side thereof provides an upper cover 32 as shown in FIG. 7 to hide a clearance at an inner side of the table part 50 or the upper cover 32 acts as an article stand for the space available for placing article being increased.

Figure 4:
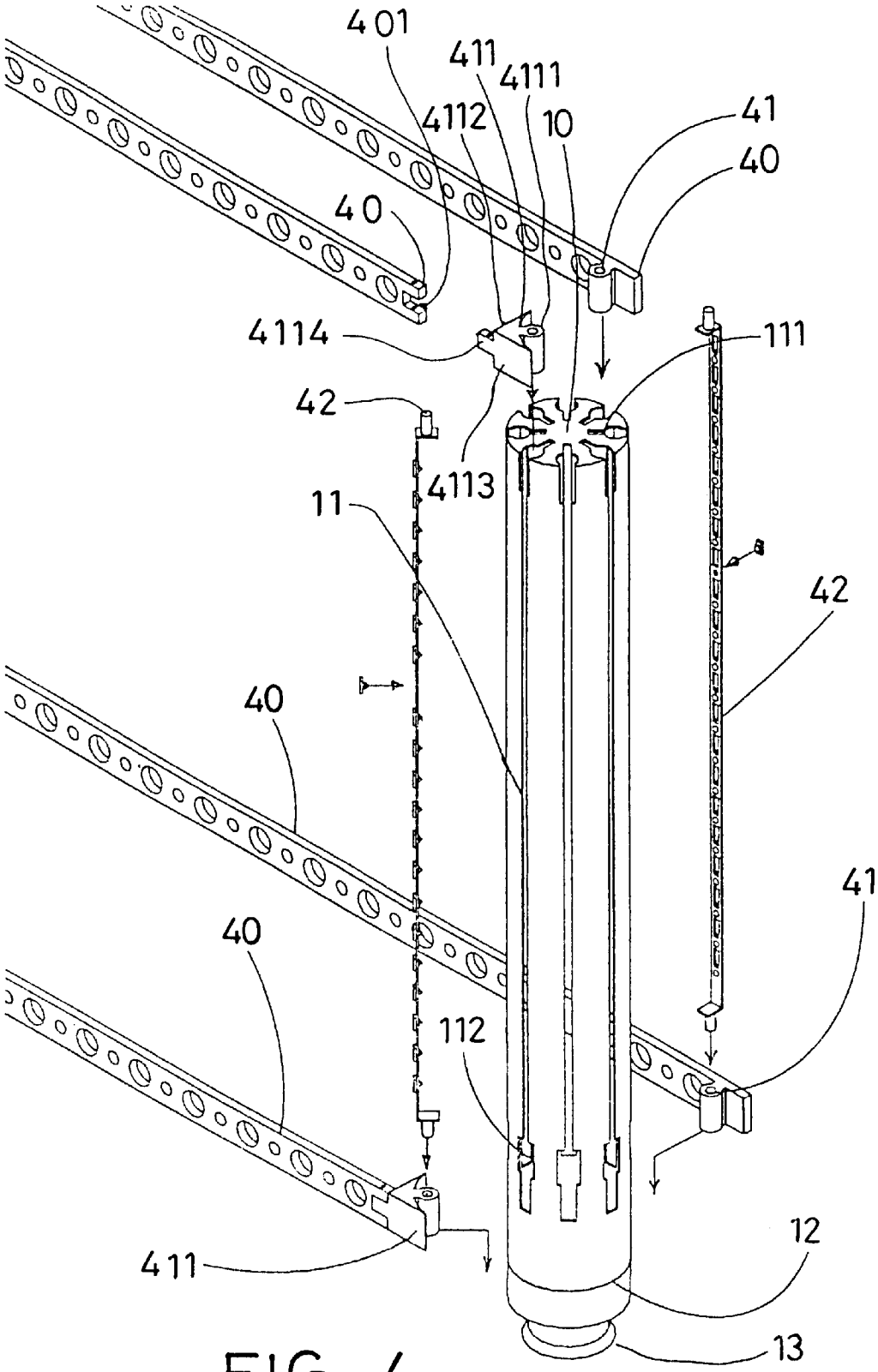
FIG. 4 is a perspective view illustrating an upright post and related parts in the lift screen of the present invention.

Referring to FIG. 4, the upright post 10 provides a plurality of vertical guiding catch grooves 11, which are made from aluminum extrusion or the like for the slide plate 31 with the partition board 30 being possible to slide along one of the guiding catch grooves 11 smoothly without sway as shown in FIG. 2. The respective guiding catch grooves 11 at the top thereof has a key shaped top fitting hole 111 and at a plurality of square post fitting holes 112 below the top fitting hole 111 for a cylindrical retaining pin and an arched retaining pin 411 attached to an end of a respective elongated trunking plate 40 can be retained on the upright post 10 to pin down the upright post 10 and the upright post 10 can be connected to another upright post 10 firmly via trunking plates 40. Further, accessories such as a table part 50, an insert hanging hole string 42, a pedal and a wire passing flute, and a large sized partition plate or a plurality of partition pieces can be hung at the box hole 112.

Figure 5:
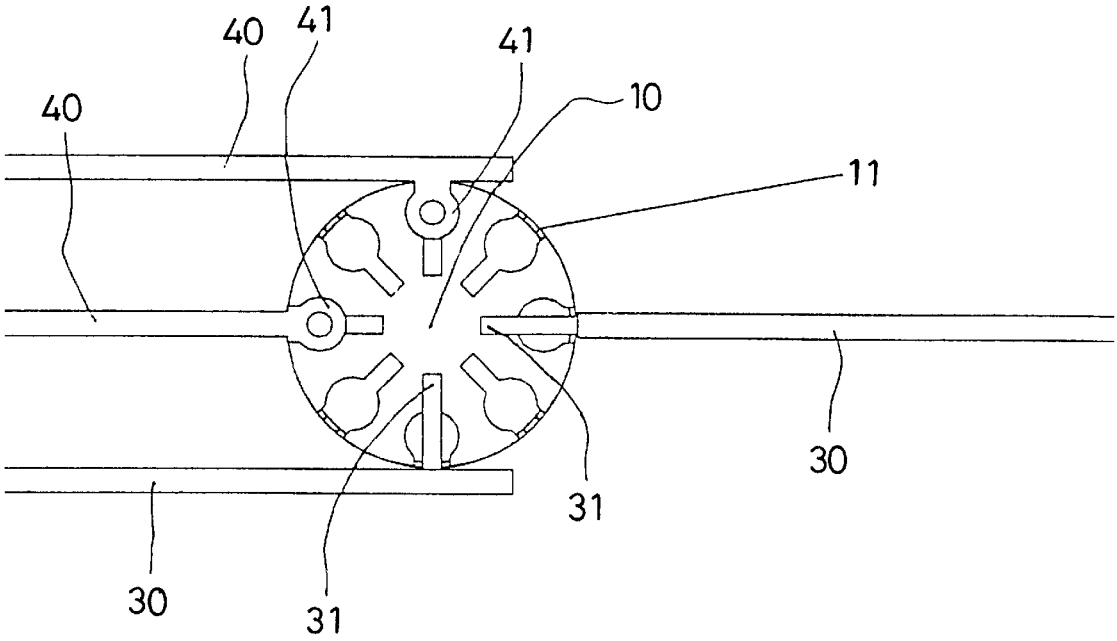
FIG. 5 is a top view of the upright post shown in FIG. 4.
Figure 6:
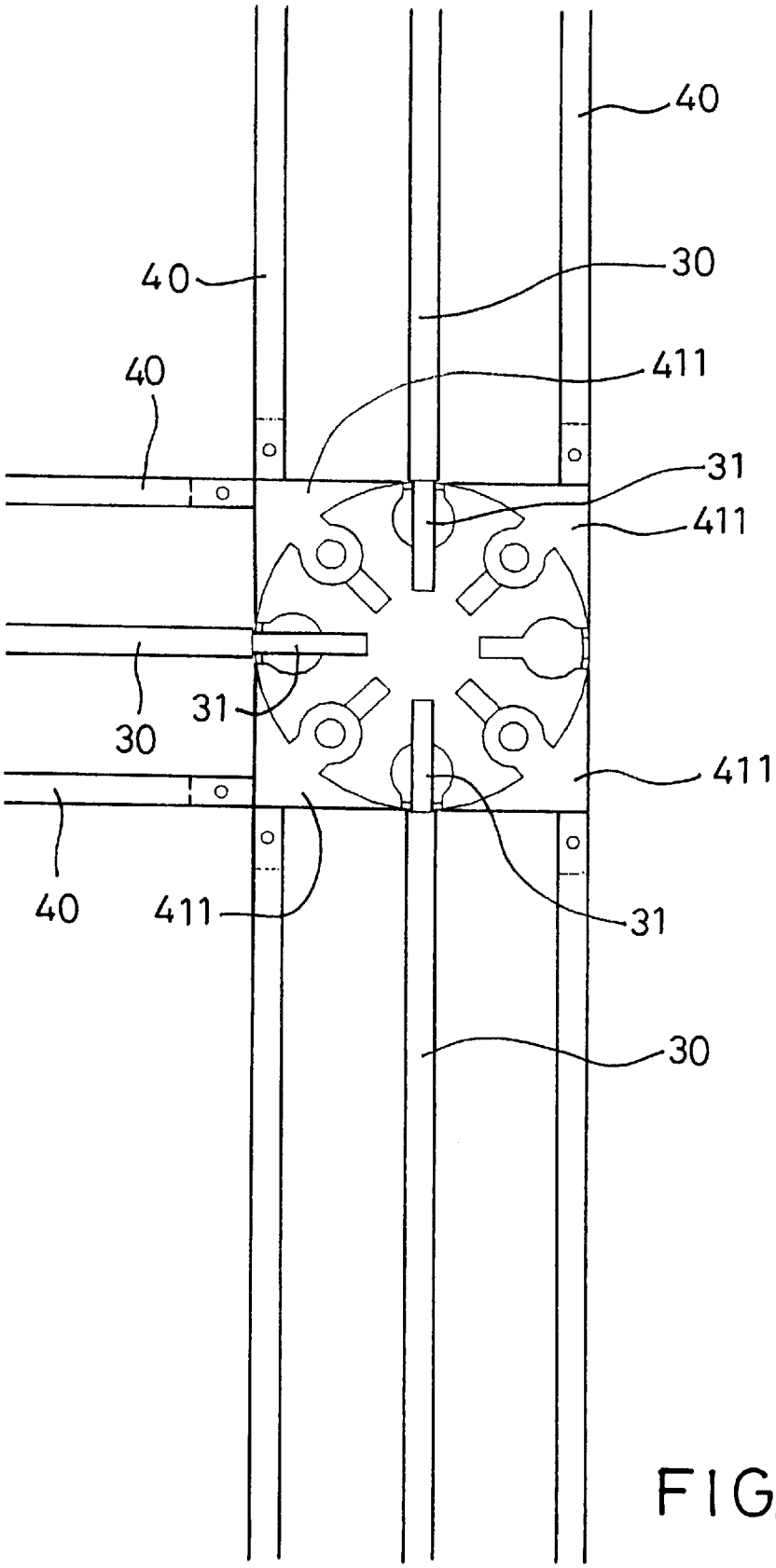
FIG. 6 is a top view perspective view illustrating arched retaining pins applied in the lift screen of the present invention.

The structure can be used not only for the preceding lift screen but also for the upright post in a conventional screen. Referring to FIGS. 5 and 6, top views related to the application of the upright post and the arched retaining pins are illustrated. The slide plate 31 and the retaining pins 41 or the arched retaining pin 411 in conjunction with the partition plate 30 and the trunking plates 40 can be arranged as a horizontal positioning or a vertical positioning such that the lift screen can be assembled fast and flexibly to obtain an optimum effect. The arched retaining pin 411 has a first plane 4111, a second plane 4112 and a third plane 4113, wherein, the first plane 4111 is an arched plane with a retaining pin with the second plane 4112 and the third plane 4113 being flat and perpendicular to each other. The third plane 4113 may provide a joint 4114 to fit with an engaging recess 401 in an end of the trunking plate 40 as shown in FIG. 4.

Figure 7:
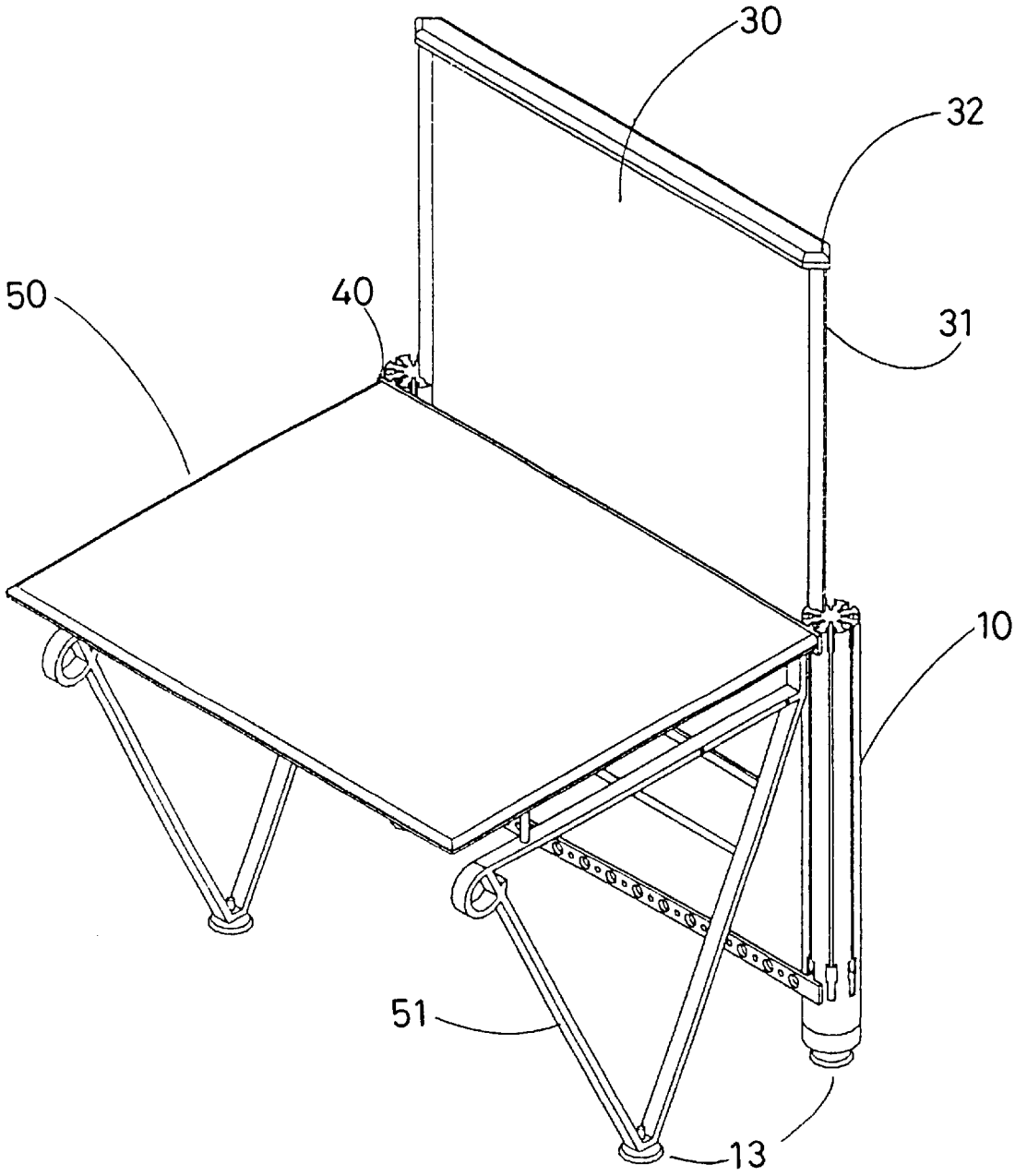
FIG. 7 is a perspective view illustrating the lift screen of the present invention in use.

Besides, an example for using the lift screen of the present invention is illustrated in FIG. 7. The trunking plate 40 is fastened to the table part 50 and the bottom of the table part 50 at two lateral sides thereof provides a leg 51 respectively so as to form a worktable.

While the invention has been described with reference to a preferred embodiment thereof, it is to be understood that modifications or variations may be easily made without departing from the spirit of this invention, which is defined in the appended claims.

What is claimed is:

1. A lift screen, comprising:

an upright post, being hollow body;

a lift mechanism, being disposed in the upright post; and a partition board, providing at least a slide plate at a facial side thereof, and a lower side thereof connecting with the lift mechanism, wherein a plurality of guiding catch groove are provided at a periphery of the upright post and the slide plate is inserted into one of the guiding catch grooves in a way of side fit with the guiding catch groove; at least a trunking plate at both ends thereof provides a retaining pin or an arched retaining pin respectively and the retaining pin or the arched retaining pin is inserted into another one of the guiding catch grooves.

2. The lift screen according to claim 1, wherein the respective guiding catch groove provides a top fitting hole.

3. The lift screen according to claim 1, wherein the respective guiding catch groove provides a plurality of post fitting holes.

4. The lift screen according to claim 1, wherein the arched retaining pin provides a first, a second and a third plane; the first plane is a arched plane with a retaining pin, the second and the third planes are flat and perpendicular to each other; and the third plane may provide a joint to engage with a recess at an end of the trunking plate.

5. A lift screen, comprising:

an upright post, being hollow body;

a lift mechanism, being disposed in the upright post; and a partition board, providing at least a slide plate at a facial side thereof, and a lower side thereof connecting with the lift mechanism, wherein the upright post at a periphery thereof provides a plurality of guiding catch grooves and each one of the guiding catch grooves has a top fitting hole and a lower post fitting hole; and an elongated trunking plate at both ends thereof provides a retaining pin and an arched retaining pin respectively to engage with the top fitting hole and the arched retaining hole respectively.

6. The lift screen according to claim 5, wherein the arched retaining pin provides a first, a second and a third plane; the first plane is a arched plane with a retaining pin, the second and the third planes are flat and perpendicular to each other; and the third plane may provide a joint to engage with a recess at an end of the trunking plate.

* * * * *